United States Patent [19]

Mueller et al.

[11] 4,316,365

[45] Feb. 23, 1982

[54] DEFROST CONTROL SYSTEM FOR REFRIGERATION SYSTEM

[75] Inventors: Dale A. Mueller, St. Paul; Robert T. Ruminsky, Bloomington; Stephen L. Serber, New Hope; Rodger C. Wolfgram, Burnsville, all of Minn.

[73] Assignee: Honeywell Inc., Minneapolis, Minn.

[21] Appl. No.: 198,508

[22] Filed: Oct. 20, 1980

[51] Int. Cl.[3] ..... F25D 21/06

[52] U.S. Cl. ..... 62/151; 62/140; 73/862.35; 416/61

[58] Field of Search ..... 62/151, 140, 128; 55/238; 415/118; 416/61; 73/862.29, 862.35, 660, 862.15

[56] References Cited

U.S. PATENT DOCUMENTS

| | | | |
|---|---|---|---|
| 2,939,295 | 6/1960 | Robson | 62/151 X |
| 3,397,550 | 8/1968 | Giwosky | 62/140 |
| 3,402,729 | 9/1968 | Richmond et al. | 73/59 X |
| 3,573,520 | 4/1971 | Dorshimer | 416/61 |
| 3,744,300 | 7/1973 | Fleury | 416/61 X |
| 4,104,888 | 8/1978 | Reedy et al. | 62/140 X |

*Primary Examiner*—William E. Tapolcai, Jr.
*Attorney, Agent, or Firm*—Roger W. Jensen

[57] ABSTRACT

An evaporator coil defrost control system for a refrigeration system comprising refrigerant compression means, a condenser coil, an evaporator coil, and an electric motor operated fan positioned adjacent to said evaporator coil and adapted, when energized, to blow air through said evaporator coil, said defrost control system comprising: strain sensing means connected to said fan blades and adapted to measure force applied to said fan and to produce a signal indicative of said measured force; controller means connected to said strain sensing means to receive the signal therefrom and having operative connections to said system, said controller being adapted to place said system in a defrost mode of operation upon said signal of said strain sensing means having a characteristic indicative of a significant frost build-up on said evaporator coil.

1 Claim, 1 Drawing Figure

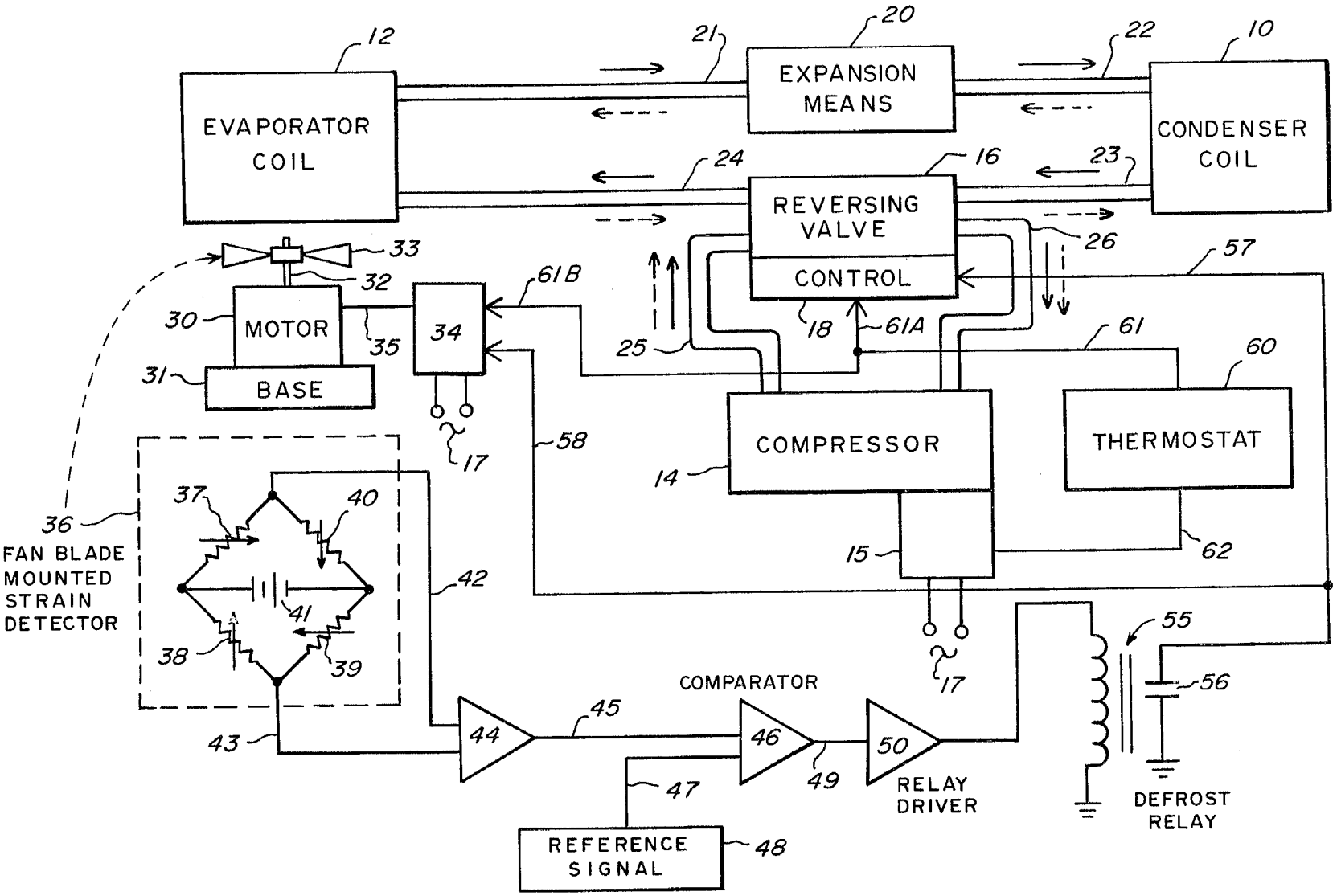
CONDENSER COIL
THERMOSTAT
DEFROST RELAY
EXPANSION MEANS
REVERSING VALVE
CONTROL
COMPRESSOR
RELAY DRIVER
COMPARATOR
REFERENCE SIGNAL
EVAPORATOR COIL
MOTOR
BASE
FAN BLADE MOUNTED STRAIN DETECTOR

DEFROST CONTROL SYSTEM FOR REFRIGERATION SYSTEM

BACKGROUND OF THE INVENTION

A vexing problem with refrigeration systems is that, under some circumstances, the evaporator coil will have frost accumulate thereon and as the frost thickness increases, the overall efficiency of the system decreases dramatically, energy is wasted and the cost of operating the system increases significantly. The problem is especially acute in the case of heat pumps and commercial refrigeration units; accordingly, many schemes have heretofore been proposed for detecting the frost and for taking corrective action for removing the frost from the outdoor coil. Examples of prior art systems include U.S. Pat. Nos. 3,170,304; 3,170,305; 3,400,553; and 4,209,994.

Our invention comprises an improved apparatus for detecting a frost build up on the evaporator coil of a refrigeration system and for initiating defrost of the system when the frost has accumulated to a preselected magnitude.

Our invention is based on the fact that as the evaporator coil begins to accumulate frost, the reactive force on the associated fan blowing air through the coil will increase. It has previously been proposed to utilize the change in one or more of the characteristics of the voltage and/or current applied to and/or flowing through the motor of the fan motor as a signal to initiate defrost. However, there are significant shortcomings to that prior art approach.

Our copending application, filed Oct. 20, 1980, Ser. No. 198,672, concurrently with the present invention discloses a defrost control system utilizing strain sensing means connected to the electric motor fan so as to measure the mechanical reactive force on the fan, the specific configuration being strain detector means positioned between the motor and its base and/or support. The present invention sets forth an alternate and unique species, i.e., another mechanical means for measuring the reactive force on the fan.

SUMMARY OF THE INVENTION

The present invention is a defrost control system for a reverse cycle refrigeration system comprising refrigerant compression means; a condenser coil; an evaporator coil; an electric motor operated multi-blade fan positioned adjacent to said evaporator coil and adapted, when energized, to blow air through said evaporator coil; and refrigerant conduit means connecting the coils. Specifically, the defrost control system comprises strain sensing means mounted on or integral with the individual blades of the fan. The strain sensing means is adapted to measure the reactive force applied to the fan blades and to produce a signal indicative of said measured force. The defrost control system also includes controller means connected to the strain sensing means to receive the signal therefrom. The controller means has operative connections to the overall refrigeration system and is adapted to place said system into a defrost mode of operation upon the signal from said strain sensing means having a characteristic indicative of a preselected reactive force on the fan blades and hence a significant frost build-up on the evaporator coil.

BRIEF DESCRIPTION OF THE DRAWING

The FIGURE is a block/schematic diagram of a reverse cycle refrigeration system embodying the present invention.

DESCRIPTION OF THE PREFERRED EMBODIMENT

Referring to the drawing, a reverse cycle refrigeration system is depicted comprising a condenser coil 10, an evaporator coil 12, a compressor 14 and refrigerant conduit means interconnecting the coils and the compressor, the refrigerant conduit means including a reversing valve 16 having a control 18, an expansion means 20, and appropriate interconnecting piping 21–26. The compressor 14 has a controller 15 energized by a suitable power supply 17. The system as thus far described is old in the art and is exemplified by the above identified patents; e.g., U.S. Pat. No. 3,170,304. Briefly, during the heating mode, i.e., when the refrigeration system is working to heat a space, compressor 14 will discharge relatively hot gaseous refrigerant through pipe 25, reversing valve 16 and pipe 23 to the condenser coil 10. The temperature of the refrigerant passing through the evaporator coil 12 is relatively cold; this will chill the evaporator coil and thereby set up the possibility of frost forming thereon, the rate of frost build up being a function of evaporator inlet air temperature, the level of humidity in the inlet air, and the temperature of the refrigerant passing through the evaporator coil. During the defrost mode the reversing valve 16 is operated so that the hot gaseous refrigerant from the compressor is routed by pipe 25, reversing valve 16 and pipe 24 to the evaporator coil 12 so as to melt ice or frost accumulated on the coil 12.

Associated with the evaporator coil 12 is an electric motor operated fan, which is shown in the drawing positioned adjacent to the evaporator coil 12, and comprises a motor 30 supported on a base 31 and adapted to drive a multi-blade fan 33 through an output shaft 32. A controller 34 energized as at 17, selectively energizes motor 30 through a connection means 35. Means for actuating controller 34 may include any of the well known means such as a room thermostat 60 (to be discussed below) or other means for commanding the operation of the motor 30 so as to operate the fan 33 selectively (or continuously) to drive air through the evaporator coil 12. A strain detector means 36 is provided comprising a plurality of individual sensors 37, 38, 39, and 40 respectively mounted on (or integral with) individual blades of the fan 33. The function of the strain detector is (as taught in our said copending application) to provide a means of measuring reactive force or strain imposed on the motor as a result of mechanical reaction of the fan to the build-up of frost within the evaporator coil 12. More specifically, as more and more frost accumulates on the coil, then an increasing reactive force will be applied to the fan blades and thus to the motor 30. The four strain gage resistive elements 37–40 are arranged in a suitable configuration such as in a Wheatstone bridge. A source of suitable electric potential, e.g., battery 41, is connected across one diagonal of the bridge and the output of the bridge is taken acorss the other diagonal by leads 42 and 43 which are connected to a suitable amplifier 44. Suitable means such as well known slip rings may be used to interconnect the elements 37–40 on the rotatable fan blades with amplifier and/or source 41. The output 45 of amplifier 44 is applied to a suitable comparator 46 which also receives a signal from a reference signal source 48 through a lead 47. The comparator 46 is designed so that it has an output signal at its output 49 only when the output from amplifier 44 exceeds the reference signal on lead 47, i.e., comparator 46 has an output at 49 when the signal at 45 differs from the signal at 47 by a preselected amount. The output signal 49 is amplified by a suitable relay driver 50 which in turn actuates a defrost relay 55. When relay 55 is actuated, a normally open contact 56 thereof closes so as to apply a control signal through leads 57 and 57A to the controller 18 to operate reversing valve 16 and through lead 57B to the controller 34 to deenergize motor 30.

The system further includes a thermostat 60 having a first output connected through leads 61 and 61A to the control 18 and through lead 61B to the controller 34 of motor 30. A second output of thermostat 60 is connected through lead 62 to the control 15 for the compressor 14.

A suitable thermostat that may be used as a component in the system depicted is the Honeywell Inc. Model T872, bimetal operated mercury switch for heating-cooling and including switch means for controlling a plurality of auxiliary heating means. The Westinghouse Company HI-RE-LI heat pump unit comprising an outdoor heat pump unit model No. HL036COW and indoor unit AG012HOK may be used as an appropriate refrigeration system.

In operation when thermostat 60 calls for operation of the refrigeration system, this will result in a control signal being applied via lead 62 to the controller 15 of the compressor 14 so as to permit compressed refrigerant to be applied, either to the evaporator coil 12 or the condenser coil 10 depending upon the mode of operation. If the system is in the space heating mode, then the hot gaseous refrigerant will be, as indicated above, directed through the reversing valve 16 so as to flow to the condenser coil 10, and thus relatively cold gaseous refrigerant and/or liquid refrigerant will flow through the evaporator coil 12.

In operation, when the overall refrigeration system is operating in the heating mode, i.e., hot refrigerant being routed to the condenser coil 10, motor 30 will be operated through the controller 34 so as to drive the fan blades 33 so as to blow air through the evaporator coil 12. If the evaporator coil is free or clear of frost, then the air from the fan 33 will flow rather free or clear through the coil and there will be little reactive force on the fan and thus on the motor and the motor base. For this situation, the bridge detector 36 has a balanced output and the signal to amplifier 44 for this situation is minimal; hence, relay 55 is not energized. As frost builds up on the evaporator coil, the flow of air therethrough becomes impeded, thus producing a reactive force on the fan blades, the elements 37, 38, 39, and 40 of the strain detector 36 being configured in the aforedescribed bridge, and functioning to detect the reaction force and to produce an output signal indicative of such reactive force. For information concerning the utilization of strain gage sensors, reference may be made to the following U.S. Pat. Nos. 2,933,706; 2,969,514; 2,959,962; 2,935,710; and 2,933,707. The control system is designed so that the strain detector 36 will produce an output at leads 42 and 43 to function to operate the defrost relay 55 upon the frost build-up on the evaporator coil reaching a preselected magnitude. In other words, when the ice build-up has reached that point, the reactive force on the fan and motor 30 will be sufficiently great so that the output signal at leads 42 and 43, as applied to amplifier 44 and then via 45 to comparator 46 will have a preselected significance relative to the reference signal appearing at 47 so as to operate, via relay driver 50, the defrost relay 55. Operation of the relay 55 closes the normally open contacts 56 so as (1) to shift, via control 18, the reversing valve 16, thus channeling the hot refrigerant directly to the evaporator coil 12 so as to expeditiously melt off the accumulated frost.

When enough frost has been melted, the defrost action may be terminated; this can be done in various ways, our preferred embodiment being a thermostat (such as a Honeywell model C-800) positioned to sense the temperature of the evaporator coil 12. For further information on defrost termination reference may be made to our copending application Ser. No. 181,165, filed Aug. 25, 1980. After defrost termination, the refrigeration system is again returned to the primary control of the thermostat 60.

While we have described a preferred embodiment of the invention, it will be understood that the invention is limited only by the scope of the following claims:

We claim:

1. An evaporator coil defrost control system (hereinafter "defrost control system") for a refrigeration system (hereinafter "system") wherein said refrigeration system comprises refrigerant compression means, a condenser coil, an evaporator coil, an electric motor operated fan positioned adjacent to said evaporator coil and adapted when energized, to blow air through said evaporator coil, and refrigerant conduit means connecting said coils, said defrost control system comprising:

strain sensing means connected to said fan and adapted to measure force to said fan and to produce a signal indicative of said measured force;

controller means connected to said strain sensing means to receive the signal therefrom and having operative connections to said system, said controller being adapted to place said system in a defrost mode of operation upon said signal of said strain sensing means having a characteristic indicative of a significant frost build-up on said evaporator coil, said strain sensing means comprisng a least four strain sensitive resistance elements mounted on separate fan blades of said fan and configured in a bridge network, the output of which is applied to said controller means, a first pair of said strain sensitive resistive elements being changed in a first sense upon an increase in reactive force and a second pair of said strain sensitive resistive elements being changed in an opposite sense upon an increase in reactive force.

* * * * *